US009158253B2

(12) United States Patent
Hasegawa

(10) Patent No.: US 9,158,253 B2
(45) Date of Patent: Oct. 13, 2015

(54) IMAGE FORMING APPARATUS WHICH DETERMINES ULTRA-FINE PARTICLE GENERATION

(71) Applicant: Konica Minolta, Inc., Tokyo (JP)

(72) Inventor: Satoshi Hasegawa, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/278,726

(22) Filed: May 15, 2014

(65) Prior Publication Data

US 2014/0348557 A1 Nov. 27, 2014

(30) Foreign Application Priority Data

May 23, 2013 (JP) ..... 2013-108952

(51) Int. Cl.
*G03G 15/00* (2006.01)
*G03G 15/20* (2006.01)

(52) U.S. Cl.
CPC ..... *G03G 15/50* (2013.01); *G03G 15/2025* (2013.01); *G03G 2215/0132* (2013.01)

(58) Field of Classification Search
CPC ..... G03G 15/2025; G03G 15/2075
See application file for complete search history.

(56) References Cited

U.S. PATENT DOCUMENTS 5,168,314 A * 12/1992 Gunji et al. ..... 399/327
2007/0048039 A1* 3/2007 Kakishima et al. ..... 399/327
2008/0044189 A1* 2/2008 Fukui ..... 399/21
2012/0189360 A1 7/2012 Shirai
2013/0045031 A1* 2/2013 Nagata et al. ..... 399/327

FOREIGN PATENT DOCUMENTS

| | | | |
|---|---|---|---|
| EP | 2141551 | A2 | 1/2010 |
| JP | 2003149966 | | 5/2003 |
| JP | 2008-040310 | A | 2/2008 |
| JP | 2010033018 | | 2/2010 |
| JP | 2011112708 | | 6/2011 |
| JP | 2012-032663 | A | 2/2012 |
| JP | 2012155024 | | 8/2012 |

OTHER PUBLICATIONS

Notice of Allowance dated Jun. 9, 2015 issued for the corresponding Japanese Patent Application No. 2013-108952.
English translation of Notice of Allowance dated Jun. 9, 2015 issued for the corresponding Japanese Patent Application No. 2013-108952.

* cited by examiner

*Primary Examiner* — Sandra Brase
(74) *Attorney, Agent, or Firm* — Lucas & Mercanti, LLP

(57) ABSTRACT

An image forming apparatus includes a generation tendency determining section to determine, before execution of a job, whether or not this job is a large-amount generation tendency job that is likely to generate a large amount of ultrafine particles. When the current job is determined to be the large-amount generation tendency job and a toner adhesion status value is equal to or higher than a first predetermined threshold representing an amount of toner adhering to a surface of a fixing member, cleaning of the fixing unit is performed before execution of the job. On the other hand, when the current job is determined to be a small-amount generation tendency job or the toner adhesion status value is less than the predetermined first threshold, the job is executed without cleaning the fixing unit.

8 Claims, 10 Drawing Sheets

IMAGE FORMING APPARATUS WHICH DETERMINES ULTRA-FINE PARTICLE GENERATION

CROSS-REFERENCE TO RELATED APPLICATIONS

This application is based upon and claims the benefit of priority from the prior Japanese Patent Application No. 2013-108952 filed on May 23, 2013, the entire contents of which are incorporated herein by reference.

BACKGROUND OF THE INVENTION

1. Field of the Invention

The present invention relates to an electrophotographic image forming apparatus. More particularly, the present invention relates to an image forming apparatus configured to minimize by-product material to be inevitably generated in a fixing unit for fixing a toner image on a paper sheet by pressing under heating.

2. Description of Related Art

Conventionally, in an image forming apparatus such as a copier, a printer, a fax machine, or a multifunction machine that combines their functions, a toner image transferred on a recording paper sheet is fixed by a fixing unit and thus an image is formed on the sheet. Specifically, the fixing unit carries out a fixing process to cause the sheet to pass through a fixing nip formed by a pair of fixing members placed in pressure contact with each other and press the sheet under heating at the time when the sheet passes through the fixing nip. The fixing members include a cylindrical roller, an endless belt member, and others.

Relating to the fixing unit, it is recently known that ultrafine particles (UFP) are generated in the fixing process. To be concrete, UFP are conceived to be generated from silicone material forming the fixing members, toner melted under heating, and others in the fixing process. To address this disadvantage, for example, JP-A-2012-32663 discloses a technique to collect UFP generated near a fixing unit. In JP-A-2012-32663, a filter impregnated with silicone oil is provided in an exhaust duct of the fixing unit. According to JP-A-2012-32663, it is expected that this filter impregnated with silicone oil can efficiently collect the generated UFP from the fixing unit.

Furthermore, JP-A-2008-40310 discloses an image forming apparatus in which one of a pair of fixing members of a fixing unit is provided with a cleaning member for cleaning the surface of the one fixing member placed in contact with a toner image bearing surface of a recording sheet. This cleaning member is switched by a changeover means between a pressure-contact position in which the cleaning member is placed in pressure contact with the fixing member and a separated position in which the cleaning member is separated from the fixing member. In a case where a large amount of toner adheres or sticks to the fixing member, the toner adhering to the fixing member is removed at the pressure-contact position. This is to prevent the toner adhering to the fixing member from transferring to a recording sheet passing through a fixing nip, thereby preventing generation of noticeable stains or smudges on the sheet. By cleaning using such a cleaning member, the UFP to be generated from the fixing unit is suppressed to a certain extent. This is because the toner adhering to the fixing member is removed and thus the toner to be heated in the fixing process is reduced.

Meanwhile, in order to collect the UFP by the aforementioned conventional method in JP-A-2012-32663, special components for collecting UFP such as a fan and a filter are required. This would cause a problem with complexity of the image forming apparatus due to those components for collecting UFP. Further, completely collecting all the generated UFP is difficult. It is thus preferred to reduce the amount of UFP to be generated.

The technique in JP-A-2008-40310 is directed to clean the fixing member to prevent the generation of noticeable stains on the recording sheet. In other words, the fixing member may be adhered with toner of such a degree that will be unnoticeable when the toner transfers to the recording sheet. The amount of UFP to be generated from the fixing unit differs according to conditions of jobs to be executed. Thus, if even the toner of an amount to the extent that will be unnoticeable when the toner transfers to the recording sheet adhere to the fixing member, this would cause a problem with the generation of a large amount of UFP in executing a job that is liable to cause an increase in generation amount of UFP.

Moreover, the generation amount of UFP can be reduced by frequently cleaning the fixing member. However, such frequent cleaning may deteriorate the productivity of image formation in the image forming apparatus configured to disable the image formation during cleaning of the fixing member. Cleaning also would cause a certain degree of load on the fixing member. Consequently, highly-frequent cleaning may shorten the life of the fixing unit.

The present invention has been made to solve the above conventional problems and has a purpose to provide an image forming apparatus configured to suppress a generation amount of UFP and also prevent deterioration in productivity of image formation and life of a fixing unit.

SUMMARY OF THE INVENTION

To achieve the above purpose, one aspect of the invention provides an image forming apparatus comprising: an image forming unit; a fixing unit configured to perform a fixing process in which a sheet having a surface bearing unfixed toner is passed through a fixing nip formed by a pair of fixing members placed in pressure contact with each other and heated to fix a toner image on the sheet; a cleaning section to remove toner from a surface of one of the fixing members, the one fixing member being located on a side facing the unfixed toner bearing surface of the sheet passing between the fixing members; a toner adhesion status value outputting section to output a toner adhesion status value representing an amount of toner adhering to the surface of the one fixing member; a generation tendency determining section to determine, before execution of a job, whether the job is a large-amount generation tendency job having a tendency to generate a large amount of ultrafine particles or a small-amount generation tendency job with a tendency to generate a small amount of ultrafine particles; and an apparatus control unit to control each part of the apparatus to execute the job, wherein the toner adhesion status value outputting section outputs a higher toner adhesion status value when the amount of toner adhering to the surface of the one fixing member is large than when the toner adhering amount is small, wherein when a current job is determined to be the large-amount generation tendency job and the toner adhesion status value before start of execution of the current job is equal to or higher than a first predetermined threshold, the apparatus control unit starts execution of the current job after performing a pre-job cleaning operation by the cleaning section, and when the current job is determined to be the small-amount generation tendency job or the toner adhesion status value before start of execution of the current job is less than the predetermined first threshold, the apparatus control unit starts execution of the current job without performing the pre-job cleaning operation by the cleaning section.

The image forming apparatus configured as above includes the generation tendency determining section for determining, before execution of a job, whether or not the job is the large-amount generation tendency job with a tendency to generate a large amount of ultrafine particles. When the current job is determined to be the large-amount generation tendency job and further the toner adhesion status value is not less than the predetermined first threshold and thus the amount of toner adhering to the fixing member is determined to be large, cleaning of the fixing unit is performed before execution of the job. This can reduce an amount of toner to be heated and melted in the job and hence reduce an amount of ultrafine particles to be generated. On the other hand, when the current job is determined to be a small-amount generation tendency job or the toner adhesion status value is less than the predetermined first threshold and hence the toner adhering amount on the fixing member is determined to be small, the job is executed without performing cleaning of the fixing unit. The reason is that, in this case, the amount of ultrafine particles generated in the job will not cause any troubles. It is thus possible to minimize the frequency of cleaning that may decrease the productivity of image formation and the life of the fixing unit.

DESCRIPTION OF EMBODIMENTS

A detailed description of a preferred embodiment of the present invention will now be given referring to the accompanying drawings. In the present embodiment, the invention is applied to an electrophotographic printer.

Figure 1:
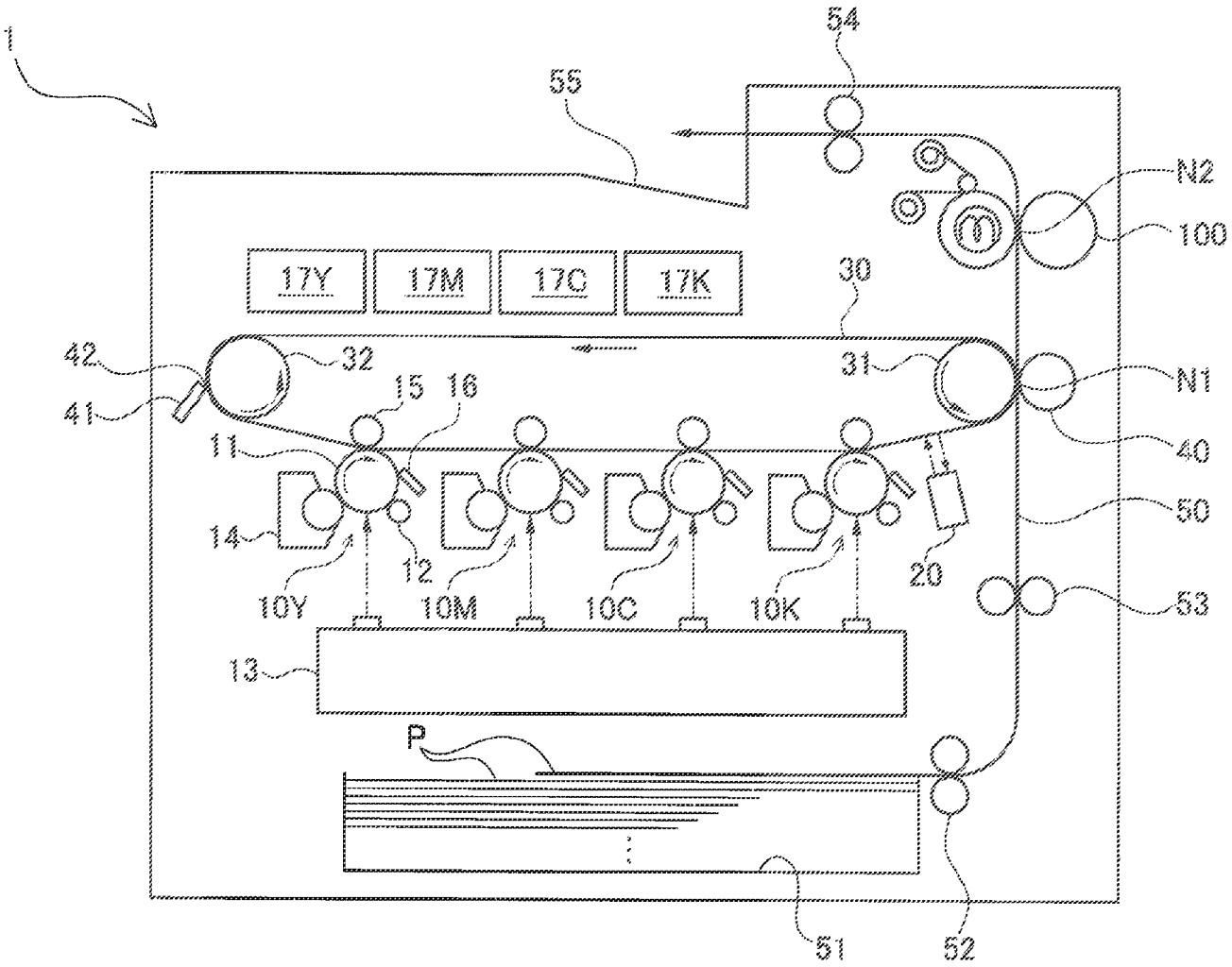
FIG. 1 is a schematic configuration view of an image forming apparatus in an embodiment.

FIG. 1 shows a schematic configuration of an image forming apparatus 1 in the present embodiment. This image forming apparatus 1 is a so-called tandem color printer including an intermediate transfer belt 30. This belt 30 is an endless belt member having electrical conductivity and is supported, at both ends in FIG. 1, by rollers 31 and 32. During image formation, the roller 31 placed on the right side in FIG. 1 is driven to rotate counterclockwise. Accordingly, the intermediate transfer belt 30 and the roller 32 placed on the left side in FIG. 1 are each driven to rotate in a direction indicated by arrows in FIG. 1.

A secondary transfer roller 40 is placed on a part of an outer peripheral surface of the intermediate transfer belt 30 on a side supported by the right roller 31. Specifically, this roller 40 is pressed against the intermediate transfer belt 30 in a direction perpendicular to an axis of the roller 40 (leftward in FIG. 1). At an area defined by the belt 30 and the roller 40 contacting with each other, a transfer nip N1 is provided to transfer a toner image formed on the belt 30 to a sheet P. During image formation, the roller 40 is driven to rotate by a friction force caused by pressure contact with the belt 30 under rotation.

Further, a belt cleaner 41 is placed on another part of the outer peripheral surface of the intermediate transfer belt 30 on a side supported by the left roller 32. Specifically, this belt cleaner 41 is pressed against the outer peripheral surface of the belt 30. A portion of the cleaner 41 pressure-contacting with the belt 30 defines a collecting region 42 for collecting residual toner having been untransferred to the sheet P at the transfer nip N1.

Below the intermediate transfer belt 30 in FIG. 1, image forming units 10Y, 10M, 10C, and 10K respectively for yellow (Y), magenta (M), cyan (C), and black (K) colors are arranged in this order from left to right. Each of these image forming units 10Y, 10M, 10C, and 10K is configured to create a toner image in relevant color and transfer the toner image onto the intermediate transfer belt 30. The image forming units 10Y, 10M, 10C, and 10K are identical in configuration to each other. In FIG. 1, therefore, only the image forming unit 10Y is assigned as a representative with reference signs.

Each of the image forming units 10Y, 10M, 10C, and 10K includes a photoconductor 11 which is a cylindrical electrostatic latent image carrier, and a charger 12, a developer 14, and a photoconductor cleaner 16, each placed around the photoconductor 11. Further, a primary transfer roller 15 is placed in a position facing the photoconductor 11 through the intermediate transfer belt 30. Under the image forming units 10Y, 10M, 10C, and 10K in FIG. 1, an exposure 13 is placed. The charger 12 is configured to uniformly charge the surface of the photoconductor 11. The exposure 13 is configured to irradiate a laser beam to the surface of each photoconductor 11 based on image data to create an electrostatic latent image. The developer 14 is configured to give stored toner to the surface of the photoconductor 11.

The primary transfer roller 15 is pressed against the intermediate transfer belt 30 in a direction perpendicular to an axis of the roller 15 (downward in FIG. 1). This pressure contact provides a primary transfer nip to transfer a toner image formed on the color photoconductor 11 to the belt 30 at an area defined by the belt 30 and the photoconductor 11 contacting with each other. The photoconductor cleaner 16 is configured to collect the toner having been untransferred from the corresponding photoconductor 11 to the belt 30.

In FIG. 1, the charger 12 illustrated is a roller-shaped roller-charging type charger. However, the present invention is not limited thereto. Alternatives are a corona discharging type charger, a blade-shaped charging member, a brush-shaped charging member, and others. The photoconductor cleaner 16 shown in FIG. 1 has a plate-like shape with one end being in contact with the outer peripheral surface of the photoconductor 11. The present invention is not limited thereto and may adopt other cleaning components; e.g., a fixed brush, a rotary brush, a roller, or a combination of some of these components. Another alternative is to adopt a cleanerless system in which the developer 14 collects untransferred toner on the photoconductor 11. In this case, the photoconductor cleaner 16 does not have to be provided.

Above the intermediate transfer belt 30 in FIG. 1, there are arranged hoppers 17Y, 17M, 17C, and 17K that contain respective color toners. The color toners contained in these hoppers are supplied for replenishment to the developers 14 for corresponding colors.

A density sensor 20 is provided in a position upstream of the transfer nip N1 located downstream of the image forming unit 10K in a rotation direction of the intermediate transfer belt 30 in order to detect an image density of a toner image transferred to the intermediate transfer belt 30. The density sensor 20 is placed to detect the outer peripheral surface of the intermediate transfer belt 30. This density sensor 20 includes a light projecting part for irradiating light toward a detection position on the outer peripheral surface of the belt 30 and a light receiving part for receiving reflection light from the toner image, which are used for example in adjusting image density.

The image forming apparatus 1 accommodate, at its lower part, a detachable sheet feeding cassette 51. A conveying path 50 is provided upward from the right side of the cassette 51 in FIG. 1. The sheets P stored in a stack manner in the cassette 51 are fed out one by one from an uppermost sheet by sheet feeding rollers 52 along the conveying path 50. On the conveying path 50 for the sheet P fed out by the roller 52, there are arranged a pair of resist rollers 53, the transfer nip N1, a fixing unit 100, and sheet output rollers 54 in this order. Further, a sheet output part 55 is provided on an upper surface of the image forming apparatus 1 on a further downstream side of the conveying path 50. The resist rollers 53 are used to adjust timing for conveying each sheet P to the transfer nip N1. The fixing unit 100 is configured to press the sheet P under heating at the fixing nip N2 to fix a toner image transferred on the sheet P.

Next, a brief explanation is given to one example of a normal image forming operation using the image forming apparatus 1 in the present embodiment. To be specific, the following explanation shows one example of the image forming operation to create a color image with toners of four colors on a sheet P loaded in the sheet feeding cassette 51.

When a normal color image is to be formed, the intermediate transfer belt 30 and the photoconductors 11 one for each color are first rotated in respective directions indicated by arrows in FIG. 1 at a predetermined circumferential speed. The outer peripheral surfaces of the photoconductors 11 are nearly uniformly charged by the corresponding chargers 12. The exposures 13 project light according to image data onto the charged outer peripheral surfaces of the photoconductors 11 to create electrostatic latent images. Successively, the electrostatic latent images are developed by the corresponding developers 14 and thus toner images are formed on the corresponding photoconductors 11.

The toner images formed on the photoconductors 11 are transferred onto the intermediate transfer belt 30 by the primary transfer rollers 15 (Primary transfer). In this way, the toner images in yellow, magenta, cyan, and black are superimposed in this order on the intermediate transfer belt 30. The superimposed toner image in four colors is conveyed to the transfer nip N1 by rotation of the intermediate transfer belt 30. Further, residual toner having been untransferred to the intermediate transfer belt 30 and remaining on the photoconductors 11 even after passing the primary transfer rollers 15 is scraped by the photoconductor cleaners 16 and removed from the photoconductors 11.

On the other hand, the sheets P loaded in the sheet feeding cassette 51 is picked one by one from an uppermost one. Each picked sheet P is conveyed along the conveying path 50 to the transfer nip N1. An incoming timing of each sheet P into the transfer nip N1 is adjusted by the resist rollers 53 so as to coincide with an incoming timing of each toner image on the intermediate transfer belt 30 into the transfer nip N1. Accordingly, at the transfer nip N1, each superimposed four-color toner image is transferred to each sheet P (Secondary transfer).

The sheet P onto which the toner image has been transferred is further conveyed to a downstream side of the conveying path 50. Specifically, after the toner image is fixed by the fixing unit 100, the sheet P is discharged out to the sheet output part 55 by the output rollers 54. The residual toner remaining on the intermediate transfer belt 30 after passing through the transfer nip N1 is collected in the collecting region 42 by the belt cleaner 41 and thus removed from the intermediate transfer belt 30.

Figure 2:
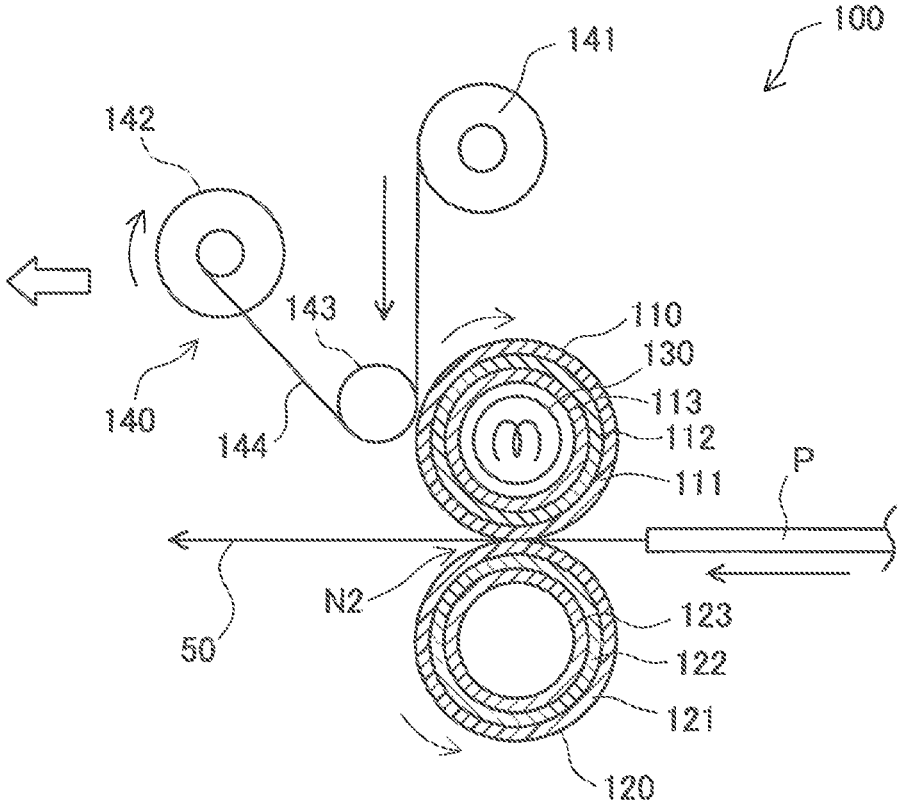
FIG. 2 is a schematic configuration view of a fixing unit of the image forming apparatus in the embodiment.

The fixing unit 100 in the present embodiment will be explained below. FIG. 2 is a schematic configuration view of the fixing unit 100. As shown in FIG. 2, the fixing unit 100 includes a fixing roller 110 and a pressure roller 120. These fixing roller 110 and pressure roller 120 are arranged in parallel to each other and each supported to be rotatable. The fixing roller 100 is placed on a side facing the toner image bearing surface of a sheet P passing through the fixing nip N2. The fixing roller 110 internally includes a heater 130 and constitutes a heating side structure to heat each sheet P passing through the fixing nip N2.

On the other hand, the pressure roller 120 constitutes a pressing side structure located facing the heating side structure with respect to the conveying path 50 and is placed in pressure contact with the fixing roller 110 in a direction perpendicular to an axis of the roller 120. Accordingly, between the fixing roller 110 and the pressure roller 120, there is formed the fixing nip N2 at which a fixing process is applied to a sheet P. During image formation, the fixing roller 110 is driven to rotate in a direction indicated by an arrow in FIG. 2. The pressure roller 120 is driven to rotate by a friction force caused by pressure contact with the fixing roller 110 under rotation.

The fixing roller 110 includes a highly-releasable surface layer 111 on an outermost circumference to prevent a sheet P from remaining adhered to the roller 110 after passing through the fixing nip N2. On an inner circumferential side of the surface layer 111, an elastic layer 112 is provided to enhance a close-contact degree between the outer peripheral surface of the fixing roller 110 and each sheet P. Further, an inner side of the elastic layer 112 is formed of a metal cored bar 113 which is a base material having sufficient strength and heat resistance. The cored bar 113 has a hollow shape having an internal space in which the heater 130 is placed. This heater 130 is used to heat the fixing roller 110 to a predetermined temperature suitable for a fixing process, for example.

The pressure roller 120 also includes a highly-releasable surface layer 121 on an outermost circumference. On an inner circumferential side of the surface layer 121, an elastic layer 122 is provided. Further, an innermost side of the pressure roller 120 is formed of a metal cored bar 123.

In the present embodiment, the surface layer 111 of the fixing roller 110 and the surface layer 121 of the pressure roller 120 are each made of a PFA (tetrafluoroethylene perfuloro alkyl vinyl ether copolymer) tube. As alternatives, the surface layers 111 and 121 may be made of fluorinated resin material such as PTFE (polytetra fuloro ethylene) and ETFE (ethylene-tetrafluoroethylene copolymer) in the form of a fluorinated tube or fluorinated coating.

In the present embodiment, each of the elastic layer 112 of the fixing roller 110 and the elastic layer 122 of the pressure roller 120 is made of silicone rubber. Besides this, other silicone material may be used, such as silicone rubber sponge which is a foam body made of silicone rubber.

The fixing unit 100 includes a fixing cleaner 140 to clean the peripheral surface of the fixing roller 110. As described above, the fixing roller 110 is placed on the side facing the toner image bearing surface of a sheet P passing through the fixing nip N2. Therefore, the peripheral surface of the fixing roller 110 is in contact with the toner carried on the sheet P while this sheet P is passing through the fixing nip N2. An outermost layer of the fixing roller 110 is formed by the highly-releasable surface layer 111. In some cases, however, even this layer 111 could not completely avoid adhesion of the toner carried on the sheet P to the surface of the fixing roller 110. Thus, the toner may adhere to the surface of the fixing roller 110.

If a large amount of toner adheres to the surface of the fixing roller 110, the toner may transfer to the sheet P at the fixing nip N2, resulting in generation of visible stains on the sheet P. As will be mentioned later, further, an amount of UFP (Ultrafine Particles) to be generated may be increased. To avoid such disadvantageous conditions, the fixing cleaner 140 is operated to remove the toner remaining on the surface of the fixing roller 110.

The fixing cleaner 140 includes, as shown in FIG. 2, a unwinding roller 141, a winding roller 142, a pressure-contact roller 143, and a cleaning web 144. The cleaning web 144 is configured to allow toner remaining on the surface of the fixing roller 110 to adhere to the cleaning web 144 itself to thereby remove the toner from the surface of the fixing roller 110. This cleaning web 144 is therefore made of a material to which toner is more likely to adhere than to the surface layer 111 of the fixing roller 110. On the unwinding roller 141, an unused part of the cleaning web 144 is set in a rolled form. The cleaning web 144 is unwound from the unwinding roller 141 and then wound up by the winding roller 142.

A part of the cleaning web 144 after unwound from the unwinding roller 141 but before wound by the winding roller 142 is looped over the pressure-contact roller 143. This roller 143 is provided in a position facing the fixing roller 110 through the cleaning web 144 looped over the roller 143 and serves to bring the cleaning web 144 in pressure contact with the surface of the fixing roller 110. The cleaning web 144 collects the toner from the surface of the fixing roller 110 at a pressure-contact point with respect to the fixing roller 110 by the pressure-contact roller 143.

In order to prevent the toner collected by the cleaning web 144 from adhering again to the fixing roller 110, the winding roller 142 is driven to rotate in a direction indicated by an arrow in FIG. 2. This causes the unwinding roller 141 to rotate, thereby unwinding an unused part of the cleaning web 144, so that the unused part comes into contact with the fixing roller 110. Specifically, the part of the cleaning web 144 to be wound by the winding roller 142 is a used part adhered with the toner collected from the fixing roller 110. To remove slack of the cleaning web 144, the unwinding roller 141 is made hard to rotate in an unwinding direction.

Cleaning of the fixing roller 110 by the fixing cleaner 140 is carried out by rotating the fixing roller 110. Specifically, as the fixing roller 110 is rotated, the surface of this roller 110 is shifted with respect to the pressure-contact point of the cleaning web 144. Thus, the fixing cleaner 140 can clean the surface of the fixing roller 110 over the entire circumference thereof.

The position of the fixing cleaner 140 shown in FIG. 2 represents that during cleaning of the fixing roller 110. During non-cleaning of the fixing roller 110, the fixing cleaner 140 is placed in a position shifted leftward in FIG. 2. That is, for a period during which cleaning is not performed, the cleaning web 144 is held in a state apart from the surface of the fixing roller 110. The reason is that while the cleaning web 144 is in contact with the surface of the fixing roller 110, this roller 110 is under a certain degree of load. Specifically, from the point of view of the life of the fixing roller 110, it is undesirable to keep the cleaning web 144 contact with the surface of the fixing roller 110.

In the fixing unit 100 configured as above, UFP occur during operation of the fixing unit 100. In general, UFP have a particle diameter of 100 nm or less. To be concrete, UFP are generated from the elastic layers 112 and 122 of the fixing roller 110 and the pressure roller 120 during for example the fixing process in which heating by the heater 130 is performed. In other words, when the fixing roller 110 and the pressure roller 120 are heated during the fixing process, the silicone rubber forming the elastic layers 112 and 122 generate siloxane which is a volatile component. It is assumed that aggregation of the generated siloxane particles results in generation of UFP. It should be noted that UFP are also generated in a case of using another silicone material such as a silicone sponge as well as the silicone rubber.

Likewise, UFP are also generated from toner. The toner carried on the sheet P is melted under heat and pressure and thus fixed to the sheet P in the fixing process. UFP will be thus generated from the toner at the time of melting. In a case where toner adhering to the surface of the fixing roller 110, UFP are also generated from the toner adhering to the surface of the fixing roller 110. This is because the toner on the surface of the fixing roller 110 is also heated together with the roller 110 heated by the heater 130.

Figure 3:
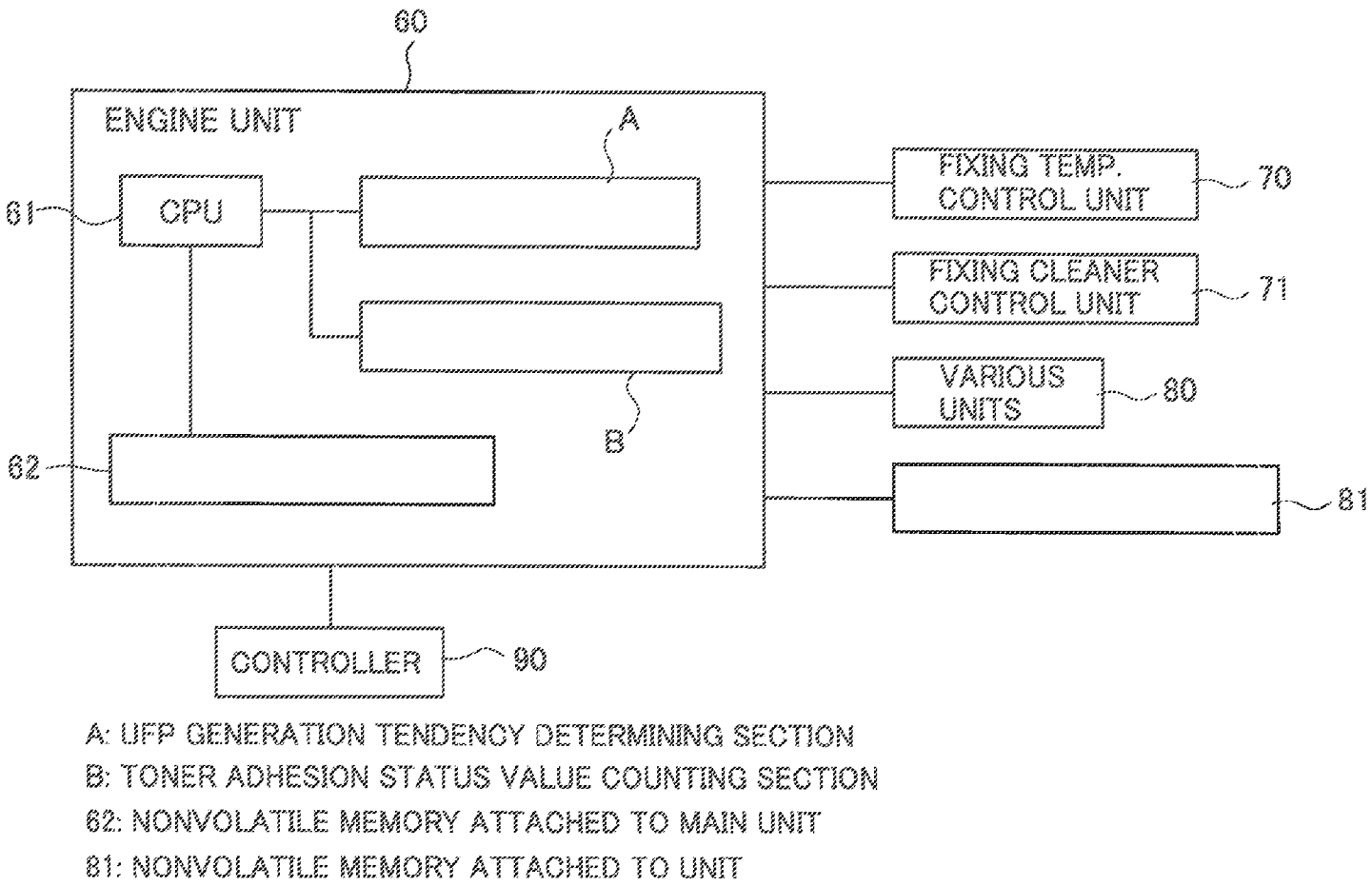
FIG. 3 is a schematic diagram showing a control configuration of the image forming apparatus in the embodiment.

FIG. 3 schematically shows a control configuration of the image forming apparatus 1. The image forming apparatus 1 includes an engine unit 60, a fixing temperature control unit 70, a fixing cleaner control unit 71, and a controller 90. The engine unit 60 includes a CPU 61 for controlling the whole apparatus, an UFP generation tendency determining section (also referred to as a "determining section") A, a toner adhesion status value counting section (also referred to as a "counting section") B, and a nonvolatile memory 62 attached to a main unit of the apparatus 1.

As shown in FIG. 3, the image forming apparatus 1 further includes various units 80 and nonvolatile memories 81 attached one to each of the various units. The various units 80 include for example toner bottles (the hoppers), imaging units (each including the photoconductor, the charger, the developer, and the photoconductor cleaner), and the fixing unit 100. As the nonvolatile memories 81, for example, a memory attached to each toner bottle stores a toner remaining amount and others, a memory attached to each imaging unit stores the number of printed sheets having been subjected to image formation by each imaging unit, and so on. A memory attached to the fixing unit 100 stores the number of printable sheets within a predetermined life of the fixing unit 100.

The CPU 61 is configured to make calculations related to image forming operations of the image forming apparatus 1 and command operations of each part or unit of the apparatus based on a print job input by a user and the condition of each part or unit of the apparatus. The nonvolatile memory 62 attached to the main unit in the present embodiment stores various thresholds such as a temperature threshold AT which will be mentioned later, an optimal set temperature of the fixing unit 100 determined in advance for each job and environmental condition, and others.

The fixing temperature control unit 70 is configured to automatically control the heater 130 to adjust the temperature of the fixing unit 100 to an optimal temperature for a job to be executed. The jobs include not only the print job but also warm-up to shift the apparatus from a non-operating state to a state ready for image formation, a ready state in which the apparatus is ready to immediately execute a print job upon receipt thereof, and others.

A most appropriate temperature for each job is set by comprehensive determination on system speed, ambient temperature and humidity of the apparatus, kind of paper sheet to be used. For instance, as the system speed corresponding to the speed of a sheet P passing through the fixing nip N2 in a print job is faster, the fixing process temperature is set higher. This is because as the time needed for the sheet P to pass through the fixing nip N2 is shorter, the amount of heat to be applied to the sheet P per unit of time has to be increased. Furthermore, as the ambient temperature of the apparatus is lower, the fixing process temperature is set higher. As the kind of a sheet P to be used is for example a thick paper, whereby more heat is drawn from the fixing unit 100 during passage through the fixing nip N2, the fixing process temperature is set higher.

Accordingly, at the time of execution of a job, the fixing temperature control unit 70 receives the optimal set temperature of the fixing unit 100 suitable for the job from the CPU 61 and controls the heater 130 to adjust the temperature of the fixing unit 100 to the received set temperature. The optimal set temperature of the fixing unit 100 is determined in advance for each condition such as job and environment and is stored in the nonvolatile memory 62 as described above.

The fixing cleaner control unit 71 is configured to control the fixing cleaner 140 in response to a command of the CPU 61. Specifically, the fixing cleaner control unit 71 controls an unwinding operation of the unwinding roller 142 of the fixing cleaner 140 to unwind the cleaning web 144. This control unit 71 also controls a switching operation of the fixing cleaner 140 between pressure-contact and separation with respect to the fixing roller 110.

The UFP generation tendency determining section A is configured to determine whether or not a job to be currently executed is a job with a condition likely to generate UFP. Herein, FIGS. 4 and 5 show a relationship between the fixing process temperature and the generation of UFP in the fixing unit 100.

Figure 4:
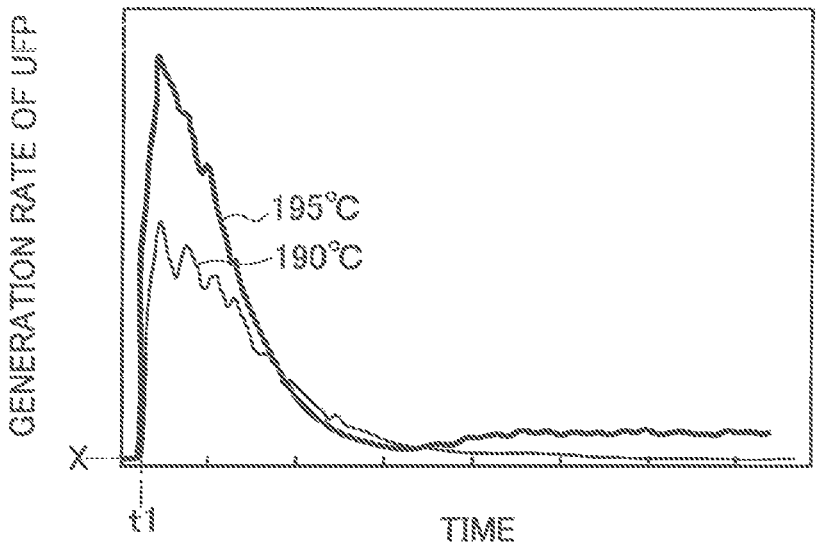
FIG. 4 is a graph showing a generation rate of UFP in the fixing unit at each fixing process temperature.

FIG. 4 is a graph showing a rate of generation of UFP at different temperatures. The generation of UFP indicated by a vertical axis of the graph is a value obtained by measurement of the number of UFP generated in the fixing unit 100 at each set temperature of 190° C. and 195° C. when the same amount of toner is heated and melted. Heating the toner has already started at time t1 indicated in a lateral axis in FIG. 4. Specifically, the generation rate indicated by X in the vertical axis related to UFP generated before the time t1 does not derive from the toner and does derive from UFP generated by the elastic layers 112 and 122 of the fixing roller 110 and the pressure roller 120 of the fixing unit 100. It is revealed from FIG. 4 that as the fixing process temperature is higher, the amount of UFP generated per unit of time tends to increase.

Figure 5:
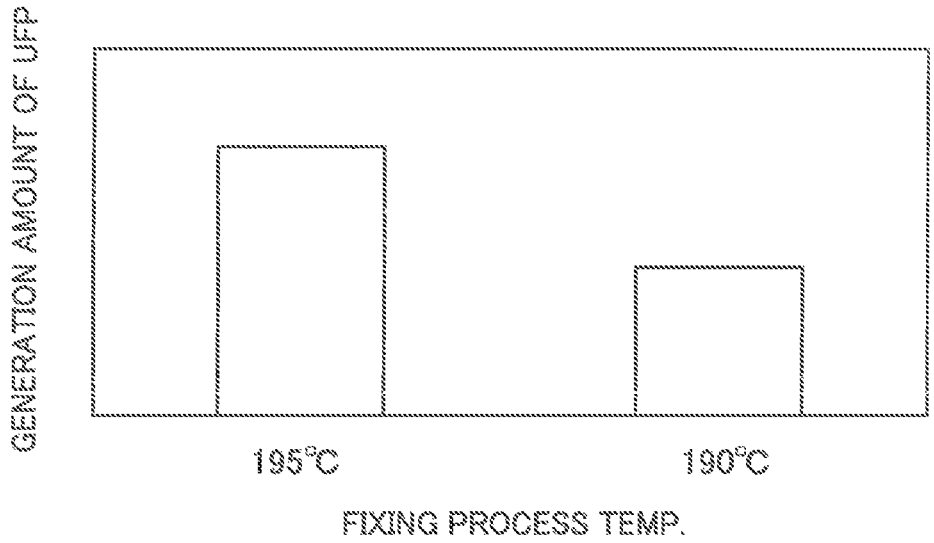
FIG. 5 is a graph showing a total amount of UFP generated in the fixing unit at each fixing process temperature.

FIG. 5 is a graph showing an amount of generation of UFP. This is a total amount of UFP generated in the fixing unit 100 at each set temperature of 190° C. and 195° C. when the same amount of toner is heated and melted. It is revealed from FIG. 5 that as the fixing process temperature is higher, a larger total amount of UFP tends to be generated in the fixing unit 100. Accordingly, it is clear from FIGS. 4 and 5 that as a job to be executed under a condition including a higher set temperature of the fixing unit 100, the amount of UFP generated is more likely to increase. More strictly, the generation amount of UFP differs according to the colors and the kinds of toner. However, the fixing unit 100 exhibits the same tendency to likely generate UFP as the set temperature of the fixing unit 100 is higher.

In the print job, furthermore, as the amount of toner passing through the fixing nip N2 increases, the amount of UFP to be generated tends to increase. That is, as the print job is to execute image formation at higher coverage corresponding to a ratio of area of an image occupying the area of the sheet P, the generation amount of UFP increases. Alternatively, in a print job to continuously execute image formation on many sheets P, as the total amount of toner to be heated and melted is increased, the generation amount of UFP becomes larger. It is generally known that the fixing unit 100 in a newer condition with a lower number of sheets subjected to image formation causes more UFP to be generated. In other words, as the remaining life of the fixing unit 100 is longer, the amount of UFP to be generated in a job to be executed is larger.

Figure 6:
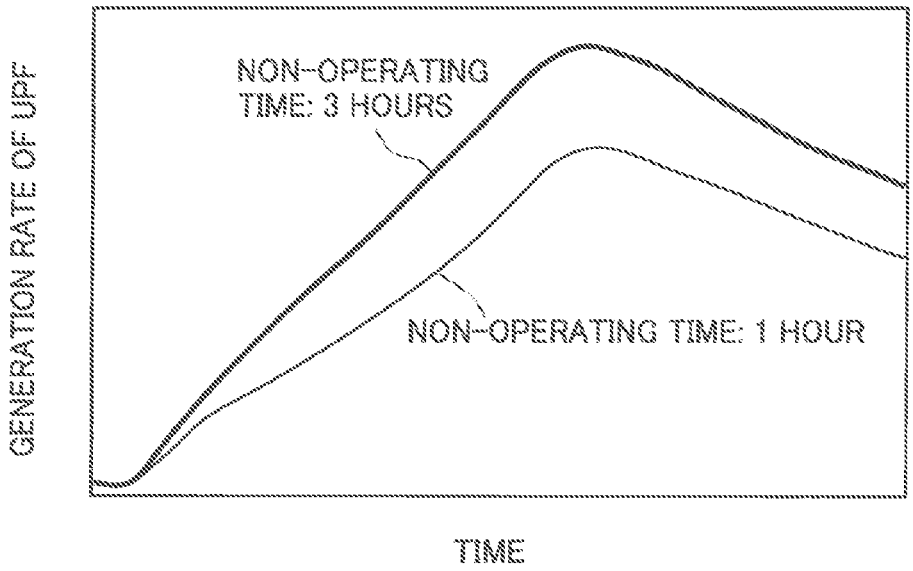
FIG. 6 is a graph showing a generation rate of UFP in the fixing unit at each non-operating time.

FIG. 6 is a graph showing a rate of generation of UFP related to each non-operating time before the start of an image forming operation. To be concrete, FIG. 6 shows the generation rate of UFP generated in the fixing unit 100 under conditions that the non-operating time is set to 3 hours and 1 hour respectively and the fixing process is then started. It is to be noted that, in both of the case with the non-operating time of 3 hours and the case with the non-operating time of 1 hour, other conditions are the same, such as a set temperature and a toner amount for subsequent fixing process. As shown in FIG. 6, it is found that the generation rate of UFP tends to be higher after the non-operating period of 3 hours than after the non-operating period of 1 hour. In other words, as the non-operating time is longer, the generation amount of UFP in the job to be executed subsequently is larger.

The UFP generation tendency determining section A thus determines, prior to execution of a job, whether or not the job is a job including a condition likely to generate a large amount of UFP (hereinafter, referred to as a "large-amount generation tendency job").

The toner adhesion status value counting section B is configured to count and output an index value representing the toner amount adhering to the surface of the fixing roller 110 as a toner adhesion status value. This section B also outputs the counted value to the CPU 61. The adhering amount of toner to the fixing roller 110 is larger as the number of sheets P having undergone the image formation is larger. As the image formation is performed at higher coverage, a larger amount of toner adheres to the fixing roller 110. Even if image formation is performed at low coverage on one sheet P, the adhering amount of toner to the fixing roller 110 increases as such image formation is performed more frequently. Specifically, the toner adhering amount on the fixing roller 110 is larger as a cumulative coverage value obtained by accumulating the coverage of each sheet P having undergone the image formation is higher.

Furthermore, there is a case where the sheet P having passed through the fixing nip N2 is not appropriately conveyed along the conveying path 50 and hence continues to stick to the surface of the fixing roller 110, which may cause a paper jam. After a jam occurs and a jammed sheet P is removed from the fixing roller 110, the toner having carried on the sheet P is liable to transfer and remain adhering to the surface of the fixing roller 110. Specifically, as the number of jams occurring in the fixing unit 100 is larger, the adhering amount of toner to the fixing roller 110 is larger.

Consequently, the toner adhesion status value counting section B counts, as a toner adhesion status value, at least one of the number of sheets P having undergone the image formation, corresponding to a value correlated to the toner adhering amount of the fixing roller 110, the cumulative coverage value of the image formation having been performed, and the cumulative number of jams in the fixing unit 100. Since cleaning is performed by the fixing cleaner 140, the toner adhering to the surface of the fixing roller 110 is almost removed. Accordingly, after cleaning using the fixing cleaner 140, the toner adhesion status value counted by the toner adhesion status value counting section B is initialized.

The controller 90 is connected to an external personal computer and others to receive command input. For instance, upon receipt of a command to carry out image formation from the personal computer, a print job is generated in the image forming apparatus 1. The engine unit 60 and the controller 90 provide communications about various information or data such as a dot counter value.

In the image forming apparatus 1 in the present embodiment, during execution of a job, when the toner adhering to the fixing roller 110 increases to such an extent that will cause many noticeable stains on the sheet P when the toner transfers to the sheet P, the cleaning using the fixing cleaner 140 is performed. To be concrete, during execution of the job, when the toner adhesion status value counted by the toner adhesion status value counting section B is not less than a stain prevention threshold, which is a threshold determined in advance for the toner adhesion status value, the cleaning using the fixing cleaner 140 is conducted. This prevents the image forming apparatus 1 in the present embodiment from generating noticeable stains on the sheet P.

Cleaning to be performed based on the stain prevention threshold is to prevent the generation of noticeable stains on a sheet P. In other words, the surface of the fixing roller 110 before subjected to the stain prevention cleaning may be adhered with toner to such an extent that will not cause noticeable stains. If the job is executed to increase the temperature of the fixing unit 100 in such a state, the toner adhering to the surface of the fixing roller 110 generates UFP. When the large-amount generation tendency job with a condition likely to cause generation of UFP is to be executed, the toner adhering amount on the fixing roller 110 is preferred to as low as possible.

In the image forming apparatus 1 in the present embodiment, therefore, when the current job input is the large-amount generation tendency job and the toner adhering amount on the fixing roller 110 before execution of the job is large, cleaning is performed to suppress the generation of UFP prior to execution of the current job. This is because in case the large-amount generation tendency job is executed while a large amount of toner remains adhering to the fixing roller 110, a large number of UFP is likely to occur.

The UFP generation tendency determining section A determines whether or not a current job is the large-amount generation tendency job. This determination about the large-amount generation tendency job by the determining section A can be made based on the set temperature of the fixing unit 100 in the current job as described above. This is because the higher the set temperature of the fixing unit 100 is, the more easily the UFP tends to occur.

As an image at higher coverage is formed, leading to a large amount of toner heated and melted, the generation amount of UFP tends to increase. Furthermore, even if the coverage of image formation on one sheet P is low, the amount of toner to be heated and melted is increased in the print job for forming images on more than one sheet P. Therefore, as the total value of coverages of all image formation performed in the current print job is higher, the generation amount of UFP in this job tends to be larger. Thus, determining whether or not the current job is the large-amount generation tendency job by the UFP generation tendency determining section A can also be made based on the total coverage value in the current job.

The determination about the large-amount generation tendency job by the UFP generation tendency determining section A may also be conducted based on the remaining life of the fixing unit 100 at the time of execution of the current job. This is because as the remaining life of the fixing unit 100 is longer, the amount of UFP generated from the fixing unit 100 tends to be larger. As another alternative, the determination about the large-amount generation tendency job by the determining section A may also be made based on the non-operating time from the previous job to the current job. This is because the non-operating time is longer, the amount of UFP generated in a job to be started subsequently tends to be larger.

Specifically, the UFP generation tendency determining section A determines whether or not the current job is the large-amount generation tendency job based on at least one condition selected from the set temperature of the fixing unit 100, the total coverage value, the remaining life of the fixing unit 100, and the non-operating time. To be concrete, the determining section A can determine about the large-amount generation tendency job by determining whether or not the condition in the current job is equal to or more than the corresponding threshold previously determined.

Further, whether or not the toner adhering amount on the fixing roller 110 in relation to execution of cleaning for suppressing the generation of UFP also may be determined based on the toner adhesion status value counted by the toner adhesion status value counting section B. Concretely, when the toner adhesion status value counted by the counting section B is equal to or more than a predetermined UFP suppression threshold, the toner adhering amount on the fixing roller 110 can be determined to be large. This UFP suppression threshold in the UFP suppression cleaning is a lower value than the stain prevention threshold in the above stain prevention cleaning.

When the current job is the large-amount generation tendency job and further the toner adhering amount on the fixing roller 110 is determined to be large, the UFP suppression cleaning is performed by the fixing cleaner 140 prior to execution of the job. This the UFP suppression cleaning performed prior to the job can decrease the toner adhering to the fixing roller 110 and thus reduce the generation amount of UFP by just that much during execution of the job.

On the other hand, when the current job is not determined to be the large-amount generation tendency job or when the toner adhering amount on the fixing roller 110 is determined to be less than the UFP suppression threshold, the job is started without performing cleaning using the fixing cleaner 140. This is because in a case of not the large-amount generation tendency job, that is, in a case where the toner adhering amount on the fixing roller 110 is small, the amount of UFP generated in the executed job is small even if the toner adhering to the fixing roller 110 is not removed in advance (a small-amount generation tendency job). That is, UFP of such an amount that will cause troubles do not occur.

Next, one example of the sequence of the image forming operation using the image forming apparatus 1 in the present embodiment will be explained referring to a flowchart in FIG. 7. In the example shown in FIG. 7, the UFP generation tendency determining section A determines whether or not the current job is the large-amount generation tendency job based on the set temperature of the fixing unit 100 in the current job. For this purpose, the determining section A in this example can obtain the set temperature of the fixing unit 100 in the current job from the CPU 61.

The toner adhesion status value counting section B counts the number of printed sheets N as a toner adhesion status value. Specifically, the number of printed sheets N by the counting section B at the time of starting the flow in FIG. 7 is the number of sheets P having been subjected to image formation performed after previous cleaning using the fixing cleaner 140.

Figure 7:
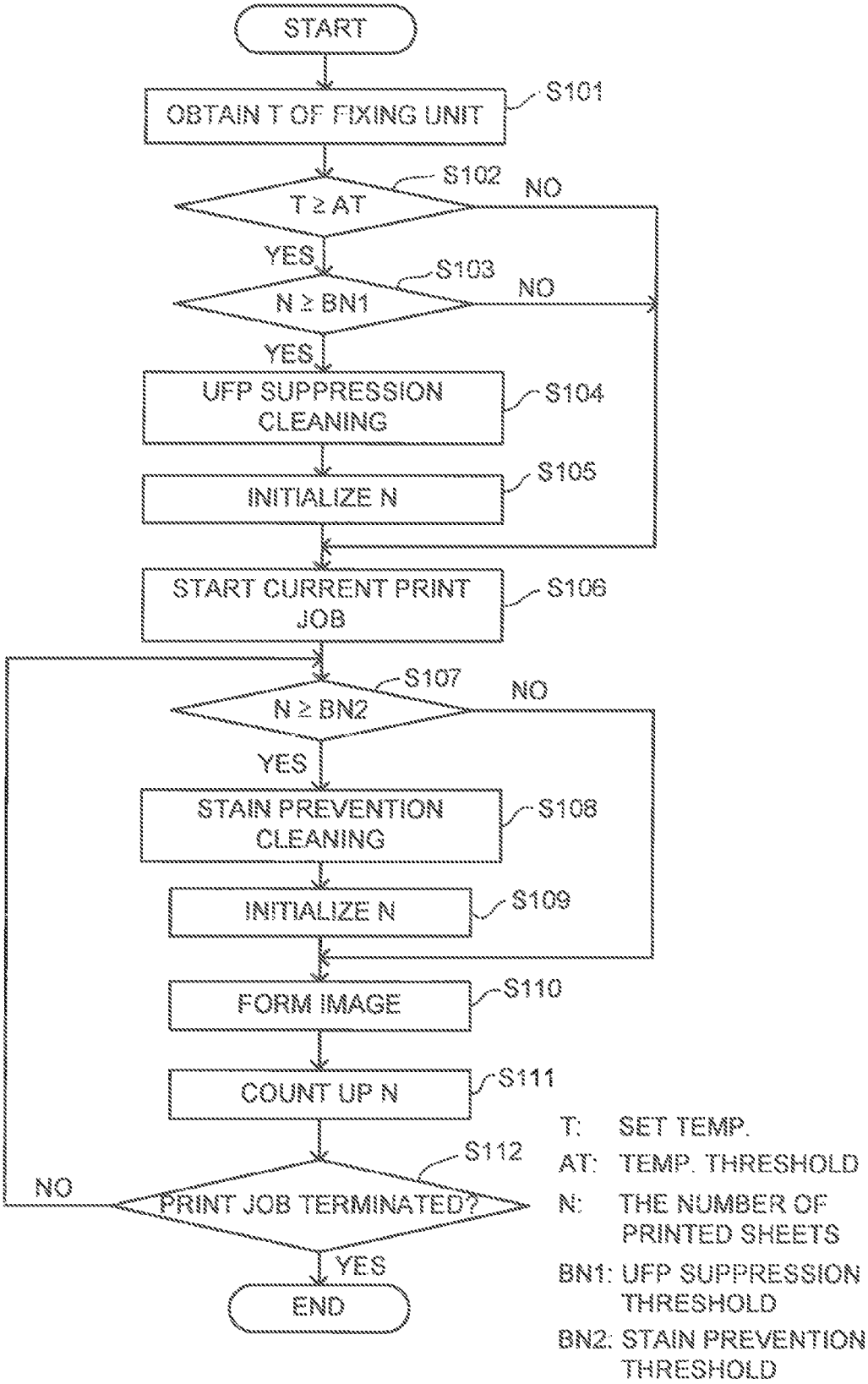
FIG. 7 is a flowchart showing an example of a sequence of image formation in which generation tendency of UFP is determined based on set temperature of the fixing unit.

As shown in FIG. 7, when a command to execute a print job is input to the image forming apparatus 1, the UFP generation tendency determining section A first obtains the set temperature T of the fixing unit 100 in the current job (S101) and then determines whether or not the obtained temperature T is equal to or more than a temperature threshold AT (S102). Herein, the temperature threshold AT is a value previously determined so that, if the temperature T is not less than the threshold AT, the current job is judged to be the large-amount generation tendency job with a condition likely to increase the amount of UFP to be generated. The temperature threshold AT can be ascertained in advance by experiments or the like and may be set to 195° C., for example.

If the temperature T is not less than the temperature threshold AT (S102: YES), the UFP generation tendency determining section A determines that the current job is the large-amount generation tendency job. In this case, the CPU 61 obtains the number of printed sheets N from the toner adhesion status value counting section B and determines whether or not the obtained number of printed sheets N is equal to or more than an UFP suppression threshold BN1 (S103). This UFP suppression threshold BN1 is a value previously determined so that, if the number of printed sheets N is not less than this threshold BN1, a current amount of toner adhering to the fixing roller 110 is considered as being so large as to likely cause a large amount of UFP to be generated in the large-amount generation tendency job. In step S103, specifically, it is determined based on the toner adhesion status value whether or not the toner adhering amount on the fixing roller 110 before execution of the job is such an amount that will cause a large amount of UFP to be generated in the large-amount generation tendency job. The UFP suppression threshold BN1 can be ascertained in advance by experiments or the like and may be set to 100 sheets, for example.

If the number of printed sheets N is not less than the UFP suppression threshold BN1 (S103: YES), the CPU 61 controls the fixing cleaner control unit 71 to perform cleaning of the fixing roller 110 by the fixing cleaner 140 (a pre-job cleaning operation) (S104). As described above, cleaning of the fixing roller 110 by the fixing cleaner 140 is carried out by rotating the fixing roller 110. In the example in FIG. 7, the fixing roller 110 is rotated two turns for the UFP suppression cleaning (S104). After this cleaning, the number of printed sheets N of the toner adhesion status value counting section B is initialized (S105) and the current print job is started (S106).

On the other hand, if the temperature T is less than the temperature threshold AT (S102: NO), it is determined that the current job is not the large-amount generation tendency job, i.e., the current job is the small-amount generation tendency job. Thus, the current print job is started (S106) without cleaning the fixing roller 110 and initializing the number of printed sheets N. Even if the current job is determined to be the large-amount generation tendency job (S102: YES), if the number of printed sheets N is less than the UFP suppression threshold BN1 (S103: NO), the current print job is also started (S106) by skipping cleaning of the fixing roller 110 and others.

Successively, when the print job is started, the heater 130 of the fixing unit 100 is controlled to increase the temperature up to the set temperature T. In the print job started, the CPU 61 obtains the number of printed sheets N from the toner adhesion status value counting section B and determines whether nor the obtained the number of printed sheets N is equal to or more than a stain prevention threshold BN2 (S107). This stain prevention threshold BN2 is a value previously determined so that, if the number of printed sheets N is equal to or more than this threshold BN2, the toner adhering amount on the fixing roller 110 is considered as being so large as to likely cause noticeable stains on the sheet P to be generated when the toner transfers to the sheet P. In step S107, specifically, it is determined based on the toner adhesion status value whether or not the toner adhering amount on the fixing roller 110 during execution of the job is such an amount as to cause noticeable stains on the sheet P to be generated when the toner transfers to the sheet P. The stain prevention threshold BN2 is a threshold higher than the UFP suppression threshold BN1 as mentioned above. This stain prevention threshold BN2 can also be obtained in advance by experiments or the like and may be set to 300 sheets, for example.

If the number of printed sheets N is not less than the stain prevention threshold BN2 (S107: YES), the CPU 61 controls the fixing cleaner control unit 71 to perform cleaning of the fixing roller 110 by the fixing cleaner 140 (an in-job cleaning operation) (S108). This stain prevention cleaning (S108), similar to the above UFP suppression cleaning (S104), is carried out by rotating the fixing roller 110 two turns. After this cleaning, the number of printed sheets N of the toner adhesion status value counting section B is initialized (S109) and the image formation in the current job is performed (S110). Specifically, the image forming units 10Y, 10M, 10C, and 10K one for each color form the toner images and also the sheet P is fed from the sheet feeding cassette 51 along the conveying path 50. The formed toner images are transferred to the sheet P at the transfer nip N1 and the fixing process is performed at the fixing nip N2. Then, the sheet P is discharged.

On the other hand, if the number of printed sheets N is less than the stain prevention threshold BN2 (S107: NO), the image formation in the current print job is performed (S110) without cleaning the fixing roller 110 and initializing the number of printed sheets N.

Further, when one sheet P undergoes the image formation, the toner adhesion status value counting section B counts up this (S111). After this image formation, successively, if a next image in the current print job is to be formed (S112: NO), the flow is returned to step S107 to repeat the above process. On the other hand, if the image formation corresponds to a last image in the current print job, the current print job is terminated (S112: YES).

By performing the image forming operation by the sequence shown in FIG. 7, it is possible to suppress the amount of UFP to be generated. This is because, in a situation that the current job is the large-amount generation tendency job including a condition with a high fixing temperature likely to generate UFP and that a large amount of toner adheres to the fixing roller 110, the fixing roller 110 is cleaned before execution of the job. That is, the job is executed after the toner is removed from the fixing roller 110, which is one of sources that generate UFP.

On the other hand, if the current job is not the large-amount generation tendency job or if the current job is the large-amount generation tendency job but the toner adhering amount on the fixing roller 110 is small, the job is executed without cleaning the fixing roller 110. This is because, in such cases, little toner adheres to the fixing roller 110 or toner adheres to the fixing roller 110 but an amount of UFP resulting from the toner will not be problematic. Since the current job can be conducted without cleaning the fixing roller 110, the productivity of the image formation is not deteriorated.

Further, a certain degree of load is applied to the fixing roller 110 when subjected to cleaning. However, the present example can minimize the frequency of cleaning the fixing roller 110 and thus prevent shortening of the life of the fixing roller 110. It is to be noted that even if the job is input to the image forming apparatus 1, in some cases, UFP suppression cleaning and stain prevention cleaning are not executed until the job is terminated.

Another example of the sequence of an image forming operation using the image forming apparatus 1 in the present embodiment will be explained, referring to a flowchart in FIG. 8, which is different from that shown in FIG. 7. In the example shown in FIG. 8, different from the example in FIG. 7, the UFP generation tendency determining section A determines whether or not the current job is the large-amount generation tendency job based on a total coverage.

The total coverage is the sum of coverages related to all image formations (i.e., the sum of coverage rates of all images to be formed) in the current job. In the example shown in FIG. 8, the controller 90 calculates the total coverage in the input current job. The coverage in the example in FIG. 8 is represented by a value obtained as a ratio of the area of a toner image with respect to the area of an image formable region which is a region (printable area) of a sheet P excepting a margin set along the outer periphery of the sheet P. As an alternative, the coverage may be represented by a value obtained as the area of a toner image with respect to the whole area of a sheet P. As another alternative, the UFP generation tendency determining section A can obtain a total coverage in the current job from the controller 90. The toner adhesion status value counting section B counts the number of printed sheets N as the toner adhesion status value in the example in FIG. 8, similar to the example in FIG. 7.

Figure 8:
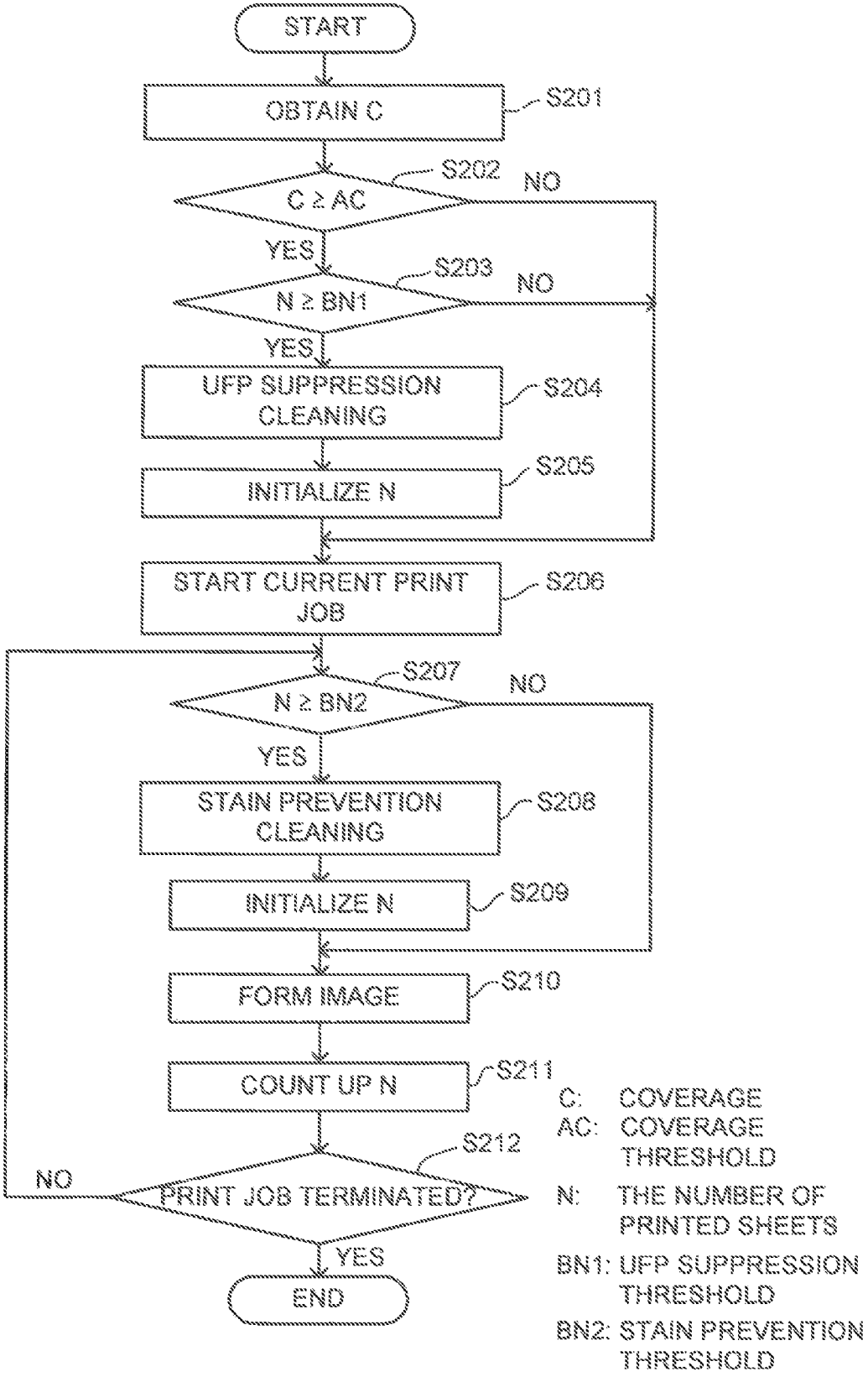
FIG. 8 is a flowchart showing another example of a sequence of image formation in which generation tendency of UFP is determined based on total coverage.

As shown in FIG. 8, when the image forming apparatus 1 receives a command to execute a print job, the UFP generation tendency determining section A first obtains a total coverage C in the current job (S201). It is then determined whether or not the obtained total coverage C is equal to or more than a coverage threshold AC (S202). Herein, the coverage threshold AC is a value previously determined so that, if the total coverage C is not less than the threshold AC, the job is judged to be the large-amount generation tendency job including a condition likely to increase the amount of UFP to be generated. The coverage threshold AC can also be obtained in advance by experiments or the like. For example, it may be determined to 2000% under the condition that a coverage for forming a solid image in an image formable region of an A4-sized sheet P is assumed as 100%.

Furthermore, if the total coverage C is not less than the coverage threshold AC (S202: YES), the UFP generation tendency determining section A determines that the current job is the large-amount generation tendency job. In this case, the CPU 61 obtains the number of printed sheets N from the toner adhesion status value counting section B and determines whether or not the obtained number of printed sheets N is equal to or more than a UFP suppression threshold BN1 (S203). If the number of printed sheets N is not less than the UFP suppression threshold BN1 (S203: YES), the fixing roller 110 is subjected to cleaning (the pre-job cleaning operation) (S204), and then the number of printed sheets N is initialized (S205) and the current print job is started (S206).

On the other hand, if the total coverage C is less than the coverage threshold AC (the small-amount generation tendency job) (S202: NO), the current print job is started (S206) without cleaning of the fixing roller 110 and others in a similar manner to FIG. 7. If the total coverage C is not less than the coverage threshold AC (S202: YES) but the number of printed sheets N is less than the UFP suppression threshold BN1 (S203: NO), the current print job is also started (S206) without cleaning of the fixing roller 110 and others. The sequence to perform the current print job (S207 to S212) in the example in FIG. 8 is similar to that in FIG. 7. Accordingly, in the example in FIG. 8, it is also possible to reduce the generation amount of UFP and prevent decreasing the productivity of image formation and shortening of the life of the fixing roller 110.

Next, another example of the sequence of an image forming operation using the image forming apparatus 1 in the present embodiment will be explained, referring to a flowchart in FIG. 9, different from those in FIGS. 7 and 8. In the example shown in FIG. 9, different from the above examples, the UFP generation tendency determining section A determines whether or not the current job is the large-amount generation tendency job based on a remaining life of the fixing unit 100.

The remaining life can be calculated by the CPU 61 by subtracting the number of sheets having been subjected to image formation in the fixing unit 100 from a predetermined number of sheets printable until the end of life stored in the nonvolatile memory 81 attached to the fixing unit 100. The UFP generation tendency determining section A in the example in FIG. 9 can obtain the remaining life of the fixing unit 100 from the CPU 61. Further, the toner adhesion status value counting section B also counts up the number of printed sheets N as the toner adhesion status value in the example in FIG. 9.

Figure 9:
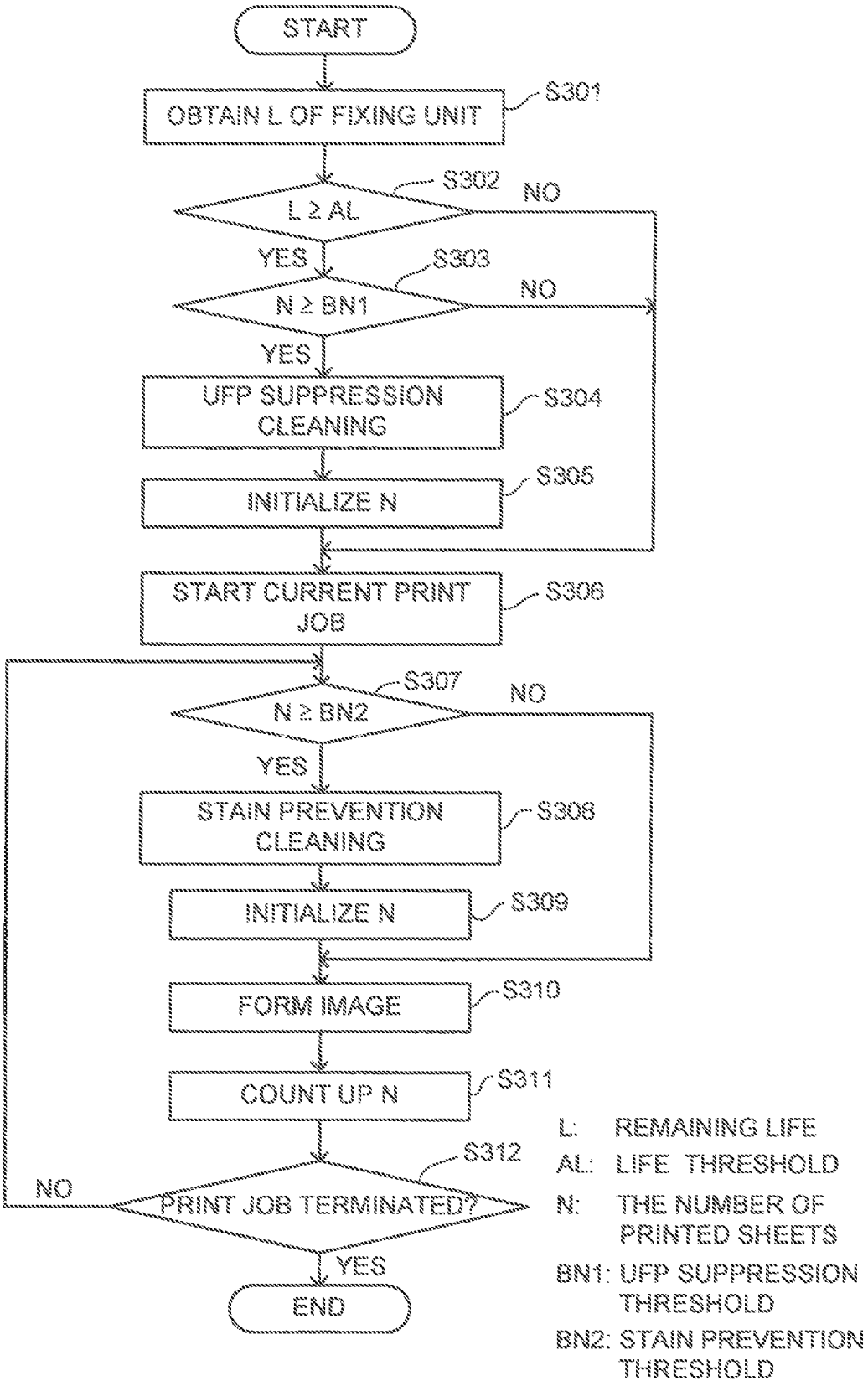
FIG. 9 is a flowchart showing another example of a sequence of image formation in which generation tendency of UFP is determined based on residual life of the fixing unit.

As shown in FIG. 9, when the image forming apparatus 1 receives a command to execute a print job, the UFP generation tendency determining section A first obtains a remaining life L of the fixing unit 100 (S301). It is then determined whether or not the remaining life L is equal to or more than a life threshold AL (S302). Herein, the life threshold AL is a value previously determined so that, if the remaining life is not less than the life threshold AL, the job is judged to be the large-amount generation tendency job including a condition likely to increase the amount of UFP to be generated. The life threshold AL can also be obtained in advance by experiments or the like. For example, it may be determined to 299,000 sheets for the fixing unit 100 whereby 300,000 sheets are printable until the end of the predetermined life.

If the remaining life L is not less than the life threshold AL (S302: YES), the UFP generation tendency determining section A determines that the current job is the large-amount generation tendency job. In this case, similarly to the above examples, the CPU 61 obtains the number of printed sheets N from the toner adhesion status value counting section B and determines whether or not the obtained the number of printed sheets N is equal to or more than the UFP suppression BN1 (S303). If the number of printed sheets N is not less than the UFP suppression threshold BN1 (S303: YES), the fixing roller 110 is subjected to cleaning (the pre-job cleaning operation) (S304), and then the number of printed sheets N is initialized (S305) and the current print job is started (S306).

On the other hand, if the remaining life L is less than the life threshold AL (the small-amount generation tendency job) (S302: NO), the current print job is started (S306) without cleaning of the fixing roller 110 and others in a similar manner to the above examples. If the remaining life L is not less than the life threshold AL (S302: YES) but the number of printed sheets N is less than the UFP suppression threshold BN1 (S303: NO), the current print job is also started (S306) without cleaning of the fixing roller 110. The sequence to perform the current print job (S307 to S312) in the example in FIG. 9 is similar to the above examples. Accordingly, in the example in FIG. 9, it is also possible to reduce the generation amount of UFP and prevent decreasing the productivity of image formation and shortening of the life of the fixing roller 110.

Next, another example of the sequence of an image forming operation using the image forming apparatus 1 in the present embodiment will be explained, referring to a flowchart in FIG. 10, different from those in the above examples. In the example shown in FIG. 10, different from the above examples, the UFP generation tendency determining section A determines whether or not the current job is the large-amount generation tendency job based on a non-operating time corresponding a period of time from the end of a previous job to the start of a current job.

In the present embodiment, specifically, the non-operating time is defined as a period of time that starts to be counted from when the previous job is terminated and the apparatus 1 comes to a non-operating state and that continues to be counted until a current job is input. Therefore, the CPU 61 in the example in FIG. 10 counts up the non-operating time of the apparatus 1. Further, the UFP generation tendency determining section A can obtain the counted non-operating time from the CPU 61. As an alternative, the engine unit 60 may be provided with a non-operating time counting section for counting up the non-operating time and transmitting a counted value to the determining section A. Further, the toner adhesion status value counting section B in the example in FIG. 10 also counts up the number of printed sheets N as the toner adhesion status value.

Figure 10:
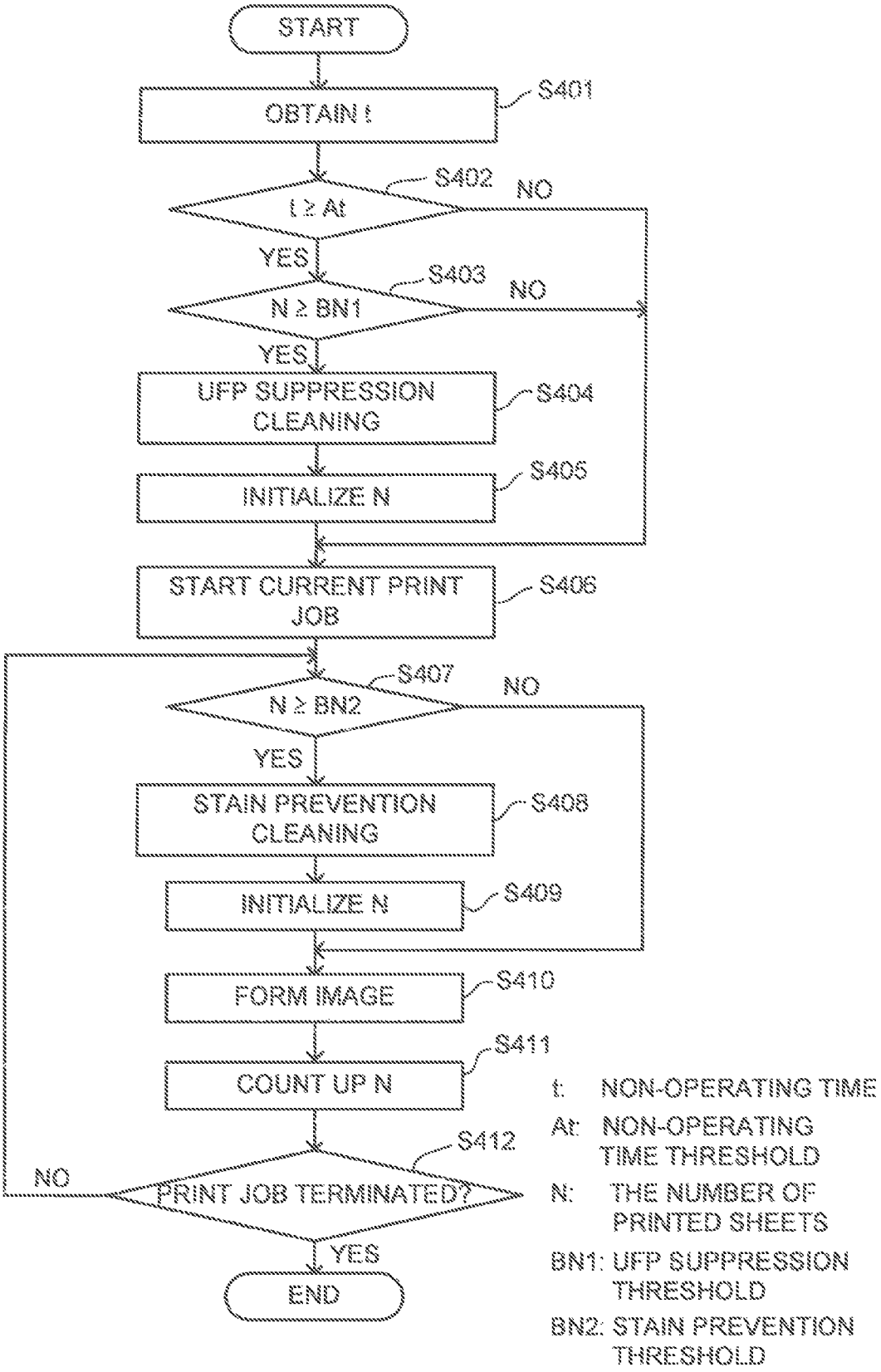
FIG. 10 is a flowchart showing another example of a sequence of image formation in which generation tendency of UFP is determined based on non-operating time.

As shown in FIG. 10, when the image forming apparatus 1 receives a command to execute a print job, the UFP generation tendency determining section A first obtains a non-operating time t representing a period from the end of the previous job to the start of the current job (S401). It is then determined whether or not the obtained non-operating time t is equal to or higher than a non-operating time threshold At (S402). Herein the non-operating time threshold At is a value previously determined so that, if the non-operating time t is not less than the threshold At, the job is judged to be the large-amount generation tendency job including a condition likely to increase the amount of UFP to be generated. The non-operating time threshold At can also be obtained in advance by experiments or the like. For example, it may be set to 1 hour.

If the fixing unit t is not less than the non-operating time threshold At (S402: YES), the UFP generation tendency determining section A determines that the current job is the large-amount generation tendency job. In this case, similar to the above examples, the CPU 61 obtains the number of printed sheets N from the toner adhesion status value counting section B and determines whether or not the obtained the number of printed sheets N is equal to or more than the UFP suppression threshold BN1 (S403). If the number of printed sheets N is not less than the UFP suppression threshold BN1 (S403: YES), the fixing roller 110 is subjected to cleaning (the pre-job cleaning operation) (S404), and then the number of printed sheets N is initialized (S405) and the current print job is started (S406).

On the other hand, if the non-operating time t is less than the non-operating time threshold At (the small-amount generation tendency job) (S402: NO), the current print job is started (S406) without cleaning of the fixing roller 110 and others in a similar manner to the above examples. If the non-operating time t is not less than the non-operating time threshold At (S402: YES) but the number of printed sheets N is less than the UFP suppression threshold BN1 (S403: NO), the current print job is started (S406) without cleaning of the fixing roller 110 and others. The sequence to perform the current print job (S407 to S412) in the example in FIG. 10 is similar to that in the above examples. In the example in FIG. 10, in addition, when the current print job is terminated (S412: YES), the non-operating time t is initialized and starts to be newly counted. Accordingly, in the example in FIG. 10, it is also possible to reduce the generation amount of UFP and prevent decreasing the productivity of image formation and shortening of the life of the fixing roller 110.

Next, still another example of the sequence of an image forming operation using the image forming apparatus 1 in the present embodiment will be explained, referring to a flowchart in FIG. 11, different from those in the above examples. In the example shown in FIG. 11, similarly to the example shown in FIG. 7, the UFP generation tendency determining section A determines whether or not the current job is the large-amount generation tendency job based a set temperature of the fixing unit 100 in a current job. The determining section A in this example can also obtain the set temperature of the fixing unit 100 in the current job from the CPU 61.

Figure 11:
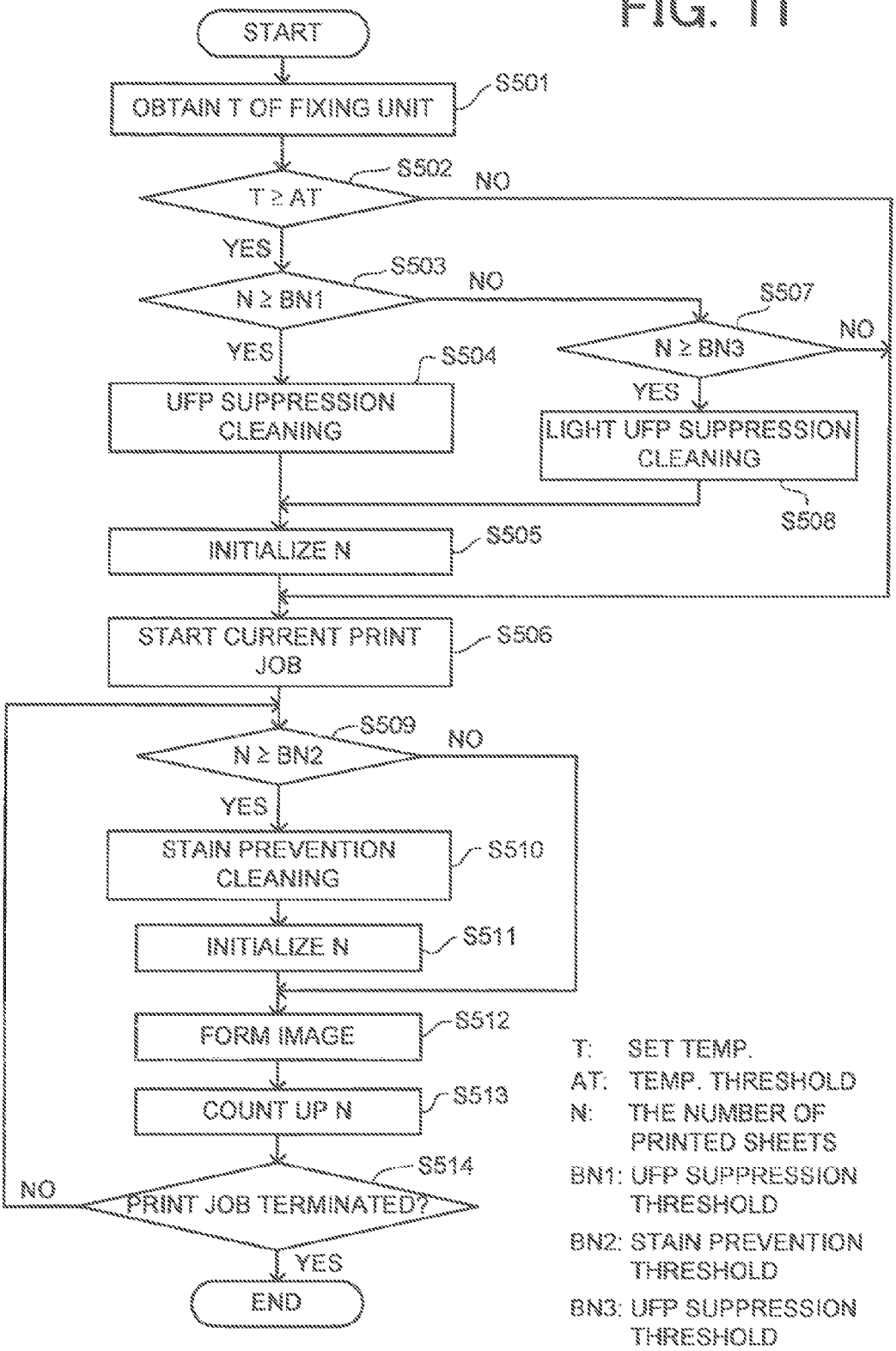
FIG. 11 is a flowchart showing another example of a sequence of image formation in which cleaning for suppressing generation of UFP is performed for a longer time as a larger amount of toner adheres to a fixing member.

However, in the example in FIG. 11, differently from the example in FIG. 7, cleaning to be performed before execution of the large-amount generation tendency job is carried out so as to provide a higher effect of removing toner as the toner adhering amount on the fixing roller 110 is larger. The toner adhesion status value counting section B also counts up the number of printed sheets N as the toner adhesion status value in the example in FIG. 11.

As shown in FIG. 11, when the image forming apparatus 1 receives a command to execute a print job, the UFP generation tendency determining section A first obtains a set temperature T of the fixing unit 100 in the current job (S501). It is then determined whether or not the obtained temperature T is equal to or higher than a temperature threshold AT (S502).

If the temperature T is not less than the temperature threshold AT (S502: YES), the determining section A determines that the current job is the large-amount generation tendency job. In this case, similar to the above examples, the CPU 61 obtains the number of printed sheets N from the toner adhesion status value counting section B and determines whether or not the obtained number of printed sheets N is equal to or higher than the UFP suppression threshold BN1 (S503). If the number of printed sheets N is not less than the UFP suppression threshold BN1 (S503: YES), the fixing roller 110 is subjected to UFP suppression cleaning (the pre-job cleaning operation) carried out by rotating the roller 110 two turns (S504).

On the other hand, if the number of printed sheets N is less than the UFP suppression threshold BN1 (S503: NO), it is further determined whether the number of printed sheets N is equal to or more than a UFP suppression threshold BN3 (S507). The UFP suppression threshold BN3 is a value previously determined to be lower than the UFP suppression threshold BN1. If the number of printed sheets N is not less than the UFP suppression threshold BN3 (S507: YES), light UFP suppression cleaning is performed (the pre-job cleaning operation) (S508). This light UFP suppression cleaning (S508) is carried out by rotating the fixing roller 110 only one turn.

The effect of removing toner in the cleaning of the fixing roller 110 becomes higher as the number of rotations of the fixing roller 110 is larger. That is, the light UFP suppression cleaning (S508) provides a lower toner removal effect than the UFP suppression cleaning (S504). The UFP suppression threshold BN3 can also be obtained in advance by experiments or the like and for example may be set to 50 sheets.

After either the UFP suppression cleaning (S504) or the light UFP suppression cleaning (S508) is performed, the number of printed sheets N is initialized (S505) and the current print job is started (S506).

If the temperature T is less than the temperature threshold At (the small-amount generation tendency job) (S502: NO), the current print job is started (S506) without cleaning of the fixing roller 110 and others in a similar manner to the that in above examples. If the temperature T is not less than the temperature threshold AT (S502: YES) but the number of printed sheets N is less than the UFP suppression threshold BN3 (S507: NO), the current print job is also started (S506) without cleaning of the fixing roller 110. The sequence to perform the current print job (S509 to S514) in the example in FIG. 11 is similar to that in the above examples. In the example in FIG. 11, a stain prevention threshold BN2 used in determination in step S509 is a threshold higher than each of the UFP suppression threshold BN1 and the UFP suppression threshold BN3.

In the example in FIG. 11, as described above, when cleaning to suppress the generation of UFP is to be performed before execution of the large-amount generation tendency job, this cleaning is carried out so as to rotate the fixing roller 110 by the larger number of turns and provide a higher effect of removing toner as the toner adhering amount on the fixing roller 110 is larger. This is because cleaning providing a low toner removal effect has only to be performed in a situation where the toner adhering amount on the fixing roller 110 is not so much. As the number of rotations of the fixing roller 110 is larger, a longer time is required to carry out the cleaning. In other words, even when cleaning to suppress the generation of UFP is to be performed but the toner adhering amount on the fixing roller 110 is not so much, the cleaning is completed in a short time, so that the productivity of image formation can be prevented decreasing. This case can also reduce a load to be applied to the fixing roller 110. Consequently, the example in FIG. 11 can suppress the generation amount of UFP and prevent the decrease in productivity of image formation and the decrease in life of the fixing roller 110.

In the above examples in FIGS. 7 to 11, the toner adhesion status value counting section B counts up, as the toner adhesion status value, the number of printed sheets N corresponding to a cumulative number of sheets P having been subjected to image formation. However, as described above, the toner adhesion status value may be a cumulative value of coverages of the image formation having been performed and the cumulative number of jams having occurred in the fixing unit 100 as well as the number of printed sheets N. In the examples shown in FIGS. 7 to 11, specifically, the counting section B may be configured to count up the cumulative coverage value of the image formation or the number of jam occurrences in the fixing unit 100 instead of the number of printed sheets N. If the counting section B is arranged to count up the number of jam occurrences in the fixing unit 100, this counting section B has only to count up the number of jam occurrences in the fixing unit 100 during execution of a print job.

When the toner adhesion status value counting section B is configured to count up the cumulative value of coverages of the image formation having been performed, the UFP suppression threshold and the stain prevention threshold may be set as a threshold for the cumulative value of coverages. When the counting section B is configured to count up the number of jam occurrences in the fixing unit 100, the UFP suppression threshold and the stain prevention threshold may be set as a threshold for the number of jam occurrences in the fixing unit 100. In these cases, similarly, each of the UFP suppression threshold and the stain prevention threshold may be determined in advance by experiments or the like.

In the examples in FIGS. 7 to 11, a determination is made on whether or not the current job is the large-amount generation tendency job and thereafter, if the current job is determined to be the large-amount generation tendency job, a determination is made on whether or not the toner adhering amount on the fixing roller 110 is large based on the toner adhesion status value. However, this order of determinations may be reversed. In other words, the toner adhering amount on the fixing roller 110 is determined first based on the toner adhesion status value and then, if the toner adhesion status value is the UFP suppression threshold or higher, it is determined whether or not the current job is the large-amount generation tendency job.

The UFP generation tendency determining section A may be configured to determine whether or not the current job is the large-amount generation tendency job based on two or more of the conditions; the set temperature T and the total coverage C in the fixing unit 100 in the current job, and the remaining life L and the non-operating time t of the fixing unit 100 at the start of the current job. Specifically, for example, if at least one of those conditions is a corresponding threshold or more, the current job can be determined to be the large-amount generation tendency job.

The toner adhesion status value counting section B may be configured to count up two or more toner adhesion status values selected from among the cumulative number of sheets P having been subjected to image formation, the cumulative value of coverages of the image formation having been performed, and the cumulative number of jams having occurred in the fixing unit 100. For example, it may be arranged so that if at least one of the counted toner adhesion status values is equal to or higher than the threshold for the toner adhesion status value, cleaning of the fixing roller 110 is performed. In this case, all the toner adhesion status values counted may be initialized after cleaning of the fixing roller 110.

The image forming apparatus 1 in the present embodiment includes, as explained in detail above, the UFP generation tendency determining section A to determine, prior to execution of the current job, whether or not the current job is the large-amount generation tendency job that is likely to generate a large amount of UFP. If the current job is the large-amount generation tendency job and the toner adhesion status value is not less than the UFP suppression threshold, the cleaning of the fixing unit 100 is conducted before execution of the concerned job. This makes it possible to reduce the generation amount of UFP in the job to be executed. On the other hand, if the current job is not the large-amount generation tendency job or if the toner adhesion status value is less than the UFP suppression threshold, the job is executed without cleaning the fixing unit 100. This can minimize the frequency of cleaning which may decrease the productivity of image formation and the life of the fixing unit 100. Accordingly, the image forming apparatus can be provided to reduce the generation amount of UFP and prevent decreasing of the productivity of image formation and shortening of the life of the fixing unit.

The above embodiments are mere examples not limiting the invention thereto. The present invention may be embodied in other specific forms without departing from the essential characteristics thereof. For example, the invention is applicable not only to the color printer but also to any image forming apparatus configured for example so as to allow communications of print jobs via public lines. Moreover, cleaning the fixing roller 110 is not limited to using the fixing cleaner 140 and for example may be performed by making a roller into pressure contact with the surface of the fixing roller 110. As another example, cleaning the fixing roller 110 may be carried out by using a cleaning sheet. Specifically, it may be configured to cause the cleaning sheet accommodated in a cleaning section to pass through the fixing nip N2, so that the cleaning sheet in passing therethrough collects the toner from the fixing roller 110.

For instance, the configuration for heating the fixing unit is not limited to the configuration that the heater 130 is placed in the fixing roller 110 and may be provided as an electromagnetic induction heating system. Furthermore, the configuration for heating the fixing unit may also be provided in the pressure roller 120 instead of the fixing roller 110. Alternatively, the heating configuration may be provided in both the fixing roller 110 and the pressure roller 120.

In the aforementioned image forming apparatus, the apparatus control unit may be arranged to repeatedly obtain the toner adhesion status value during execution of a job and, if the obtained toner adhesion status value becomes equal to or higher than a predetermined second threshold higher than a first threshold, cause the cleaning section to perform cleaning during a job (an in-job cleaning operation).

In the aforementioned image forming apparatus, preferably, the generation tendency determining section determines that the current job is the large-amount generation tendency job if the set temperature of the fixing unit in the current job is equal to or higher than the previously set temperature threshold, but determines that the current job is a job with a tendency to generate a small amount of UFP (hereinafter, referred to as a "small-amount generation tendency job") if the current job is not determined to be the large-amount generation tendency job. This is because as the set temperature of the fixing unit is higher, the generation amount of UFP tends to increase.

In the aforementioned image forming apparatus, the generation tendency determining section may also be configured to determine that the current job is the large-amount generation tendency job if the total value of coverages of all sheets in the current job, the coverage representing the ratio of the area of a toner image occupying the area of a predetermined region of each sheet, but determines that the current job is the small-amount generation tendency job if the current job is not determined to be the large-amount generation tendency job. This is because as the total coverage value in the job is higher, the generation amount of UFP tends to increase.

In the aforementioned image forming apparatus, the generation tendency determining section may also be configured to determine that the current job is the large-amount generation tendency job if the remaining life of the fixing unit is the predetermined life threshold or higher, but determines that the current job is the small-amount generation tendency job if the current job is not determined to be the large-amount generation tendency job. This is because the remaining life of the fixing unit is longer and the fixing unit is in a newer condition, the fixing unit tends to generate a larger amount of UFP.

In the aforementioned image forming apparatus, the generation tendency determining section may be configured to determine the current job to be the large-amount generation tendency job if the non-operating time for which the apparatus is not operated from the end of the previous job to the start of the current job is equal to or higher than the predetermined non-operating time threshold, but determines the current job is the small-amount generation tendency job if the current job is not determined to be the large-amount generation tendency job. This is because as the non-operating time is longer, the generation amount of UFP in a job to be started subsequently tends to increase.

The aforementioned image forming apparatus is preferably configured such that, when causing the cleaning section to perform cleaning before a job (a pre-job cleaning operation), the apparatus control unit sets a longer execution time of the pre-job cleaning operation when the toner adhesion status value obtained from the toner adhesion status value outputting section is high than when it is low. In a case where the toner adhering amount on the fixing member is not so high, the adhered toner can be removed sufficiently by short-time cleaning that provides a small removal effect. That is, the productivity of image formation and the life of the fixing unit can be prevented from decreasing.

Furthermore, the aforementioned image forming apparatus is preferably configured such that the toner adhesion status value outputting section outputs, as the toner adhesion status value, at least one of the cumulative number of sheets having been subjected to image formation, the cumulative value of coverages of the sheets subjected to image formation, the coverage representing the ratio of the area of each toner image occupying the area of the predetermined region of each sheet, and the cumulative number of jams having occurred in the fixing unit and to initialize the toner adhesion status value after the cleaning section performs a cleaning operation. The cumulative number of sheets subjected to image formation, the cumulative value of coverages of sheets subjected to image formation, and the cumulative number of jam occurrences in the fixing unit are each related to the toner adhering amount on the fixing member and index values thereof. It should be noted that the cleaning operation by the cleaning section includes both the pre-job cleaning operation and the in-job cleaning operation.

REFERENCE SINGS LIST

1 Image forming apparatus
10Y, 10M, 10C, 10K Image forming unit
60 Engine unit
61 CPU
62 Nonvolatile memory
100 Fixing device
110 Fixing roller
120 Pressure roller
130 Heater
140 Fixing cleaner
A UFP generation tendency determining section
B Toner adhesion status value counting section
N2 Fixing nip
P Sheet

What is claimed is:

1. An image forming apparatus comprising:

an image forming unit;

a fixing unit configured to perform a fixing process in which a sheet having a surface bearing unfixed toner is passed through a fixing nip formed by a pair of fixing members placed in pressure contact with each other and heated to fix a toner image on the sheet;

a cleaning section to remove toner from a surface of one of the fixing members, the one fixing member being located on a side facing the unfixed toner bearing surface of the sheet passing between the fixing members;

a toner adhesion status value outputting section to output a toner adhesion status value representing an amount of toner adhering to the surface of the one fixing member;

a generation tendency determining section to determine, before execution of a job, whether the job is a large-amount generation tendency job having a tendency to generate a large amount of ultrafine particles or a small-amount generation tendency job with a tendency to generate a small amount of ultrafine particles; and an apparatus control unit to control each part of the apparatus to execute the job, wherein the toner adhesion status value outputting section outputs a higher toner adhesion status value when the amount of toner adhering to the surface of the one fixing member is large than when the toner adhering amount is small, wherein when a current job is determined to be the large-amount generation tendency job and the toner adhesion status value before start of execution of the current job is equal to or higher than a first predetermined threshold, the apparatus control unit starts execution of the current job after performing a pre-job cleaning operation by the cleaning section, and when the current job is determined to be the small-amount generation tendency job or the toner adhesion status value before start of execution of the current job is less than the predetermined first threshold, the apparatus control unit starts execution of the current job without performing the pre-job cleaning operation by the cleaning section.

2. The image forming apparatus according to claim 1, wherein the apparatus control unit is configured to:

repeatedly obtain the toner adhesion status value during execution of the job; and cause the cleaning section to perform an in-job cleaning operation when the obtained toner adhesion status value is equal to or higher than a second threshold previously determined to be higher than the first threshold.

3. The image forming apparatus according to claim 1, wherein the generation tendency determining section is configured to:

determine that the current job is the large-amount generation tendency job when a set temperature of the fixing unit in the current job is equal to or higher than a predetermined fixing unit threshold, and determine that the current job is the small-amount generation tendency job when the current job is not determined to be the large-amount generation tendency job.

4. The image forming apparatus according to claim 1, wherein the generation tendency determining section is configured to:

determine that the current job is the large-amount generation tendency job when a total amount of coverages of all sheets to be subjected to the current job is equal to or higher than a predetermined coverage threshold, the coverage representing a ratio of an area of a toner image occupying an area of a predetermined region of each sheet; and determine that the current job is the small-amount generation tendency job when the current job is not determined to be the large-amount generation tendency job.

5. The image forming apparatus according to claim 1, wherein the generation tendency determining section is configured to:

determine that the current job is the large-amount generation tendency job when a remaining life of the fixing unit is equal to or higher than a predetermined life threshold; and determine that the current job is the small-amount generation tendency job when the current job is not determined to be the large-amount generation tendency job.

6. The image forming apparatus according to claim 1, wherein the generation tendency determining section is configured to:

determine that the current job is the large-amount generation tendency job when a non-operating time for which the apparatus is unoperated from an end of a previous job to a start of the current job is equal to or higher than a predetermined non-operating time threshold; and determine that the current job is the small-amount generation tendency job when the current job is not determined to be the large-amount generation tendency job.

7. The image forming apparatus according to claim 1, wherein to cause the cleaning section to perform the pre-job cleaning operation, the apparatus control unit sets a longer execution time of the pre-job cleaning operation when the toner adhesion status value obtained from the toner adhesion status value outputting section is higher than when the toner adhesion status is lower.

8. The image forming apparatus according to claim 1, wherein the toner adhesion status value outputting section is configured to:

output, as the toner adhesion status value, at least one of cumulative number of sheets having been subjected to image formation, cumulative value of coverages of the sheets having been subjected to image formation, the coverage representing a ratio of an area of a toner image occupying an area of a predetermined region of each sheet, and cumulative number of jams having occurred in the fixing unit; and initialize the toner adhesion status value when the cleaning section performs the cleaning operation.

* * * * *